US006168842B1

(12) United States Patent
Thoma

(10) Patent No.: US 6,168,842 B1
(45) Date of Patent: Jan. 2, 2001

(54) ADHESIVE LABEL

(75) Inventor: Alexander Thoma, Oberthulba (DE)

(73) Assignee: Koenig & Bauer Aktiengesellschaft, Wurzburg (DE)

( * ) Notice: Under 35 U.S.C. 154(b), the term of this patent shall be extended for 0 days.

(21) Appl. No.: 09/147,429

(22) PCT Filed: Jun. 19, 1997

(86) PCT No.: PCT/DE97/01264

§ 371 Date: Dec. 23, 1998

§ 102(e) Date: Dec. 23, 1998

(87) PCT Pub. No.: WO97/49628

PCT Pub. Date: Dec. 31, 1997

(30) Foreign Application Priority Data

Jun. 25, 1996 (DE) ..... 196 25 366

(51) Int. Cl.[7] ..... B65H 19/10

(52) U.S. Cl. ..... 428/43; 428/40.1; 428/42.2; 428/42.3; 428/57; 428/58; 428/131; 428/906; 242/556.1

(58) Field of Search ..... 242/556.1; 428/40.1, 428/42.1, 42.2, 42.3, 43, 131, 906, 57, 58; 206/389, 414

(56) References Cited

U.S. PATENT DOCUMENTS

| | | | | |
|---|---|---|---|---|
| 2,149,833 | * | 3/1939 | Bernard | 242/58 |
| 4,113,906 | * | 9/1978 | Brandwein | 428/42 |
| 4,555,288 | * | 11/1985 | Nozaka | 156/191 |
| 5,149,571 | * | 9/1992 | Croell | 428/40 |
| 5,750,217 | * | 5/1998 | Kearby et al. | 428/34.8 |

FOREIGN PATENT DOCUMENTS

| | | |
|---|---|---|
| 1267930 | 3/1965 | (DE) . |
| 8801163 | 7/1989 | (DE) . |
| 9421320 | 3/1995 | (DE) . |
| 9000980 | 11/1991 | (NL) . |
| WO 95/05989 | 3/1995 | (WO) . |

* cited by examiner

*Primary Examiner*—Nasser Ahmad
*Assistant Examiner*—Alicia Chevalier
(74) *Attorney, Agent, or Firm*—Jones, Tullar & Cooper PC

(57) ABSTRACT

An adhesive label is useable to overlie an adhesive strip and is situated at the leading end of a paper web wound in a roll. The adhesive label is positioned in the running area of a driving belt of a roll changer in a rotary printing machine and is one of several two part labels that are each provided with a defined tear line. These labels are placed over the cut edge of the first layer of the paper web. Each label is provided, in its trailing portion with a plurality of holes.

10 Claims, 2 Drawing Sheets

ADHESIVE LABEL

FIELD OF THE INVENTION

The present invention relates to an adhesive label for a supply roll of a paper web for a web-fed rotary printing press.

DESCRIPTION OF THE PRIOR ART

Adhesive labels for supply paper rolls are generally known, for use wherein the beginning of the paper web is fastened on the second layer of the paper web. DE 88 01 163 U1 describes an adhesive label with a predetermined tear line for attaching the beginning of a paper web to a paper web supply roll.

It is disadvantageous with this prior device that no connection between the web running out and the beginning of the paper web supply roll is created in the area of the adhesive label.

WO 95/05989 describes an adhesive label for fastening the beginning of a paper web on a paper web supply roll. This adhesive label is provided with a predetermined tear line.

DE-AS 12 67 930 discloses an adhesive label for fastening an adhesive strip of an paperweb supply roller.

SUMMARY OF THE INVENTION

The present invention has the object of providing an adhesive label for affixing a beginning of a paper web on a paper web supply roll.

In accordance with the present invention, this object is attained by providing an adhesive label which has, in the direction of rotation of the paper web supply roll, a leading label element and a trailing label element. Both of these label elements are delimited by a predetermined tear line. At least the trailing label element has holes. The trailing label element also has a width which corresponds, at least, to the width of the adhesive application or strip applied to the beginning of the paper web.

The advantages which can be achieved by of the present invention consist in particular in that, even when the drive belt used to rotate the fresh paper web supply roll is placed obliquely to the roll, and when there is a shortened run-up time of a fresh paper web supply roll provided with one or several adhesive labels, there is no "fly-away" and detachment of the holding labels from the beginning of the paper web. A relative axial movement between the paper web supply roll and the drive belt is absorbed without damage by the adhesive label. If in the course of acceleration of the paper web supply roll there should be penetration of adhesive through the perforations of the adhesive label, so that adhesive also gets on the drive belt, no "lifting" of the paper web beginning at each revolution takes place because of the retentive effect of the closure element of the adhesive label. Therefore no tearing of the adjoining holding labels and no "fly-away" of the paper web occurs. Because the paper web beginning is glued to the second layer of the supply roll of paper web, at least in the area of the belt travel, the penetration of air during the start up between the beginning of the paper web and the second layer and therefore a premature tearing of the holding labels is prevented. An open adhesive, as well as an adhesive strip with adhesive on both sides can be used as the adhesive application at the beginning of the paper web.

BRIEF DESCRIPTION OF THE DRAWINGS

The present invention is represented by several preferred embodiments and will be described in greater detail in what follows. Shown are in.

DESCRIPTION OF THE PREFERRED EMBODIMENTS

Figure 1:
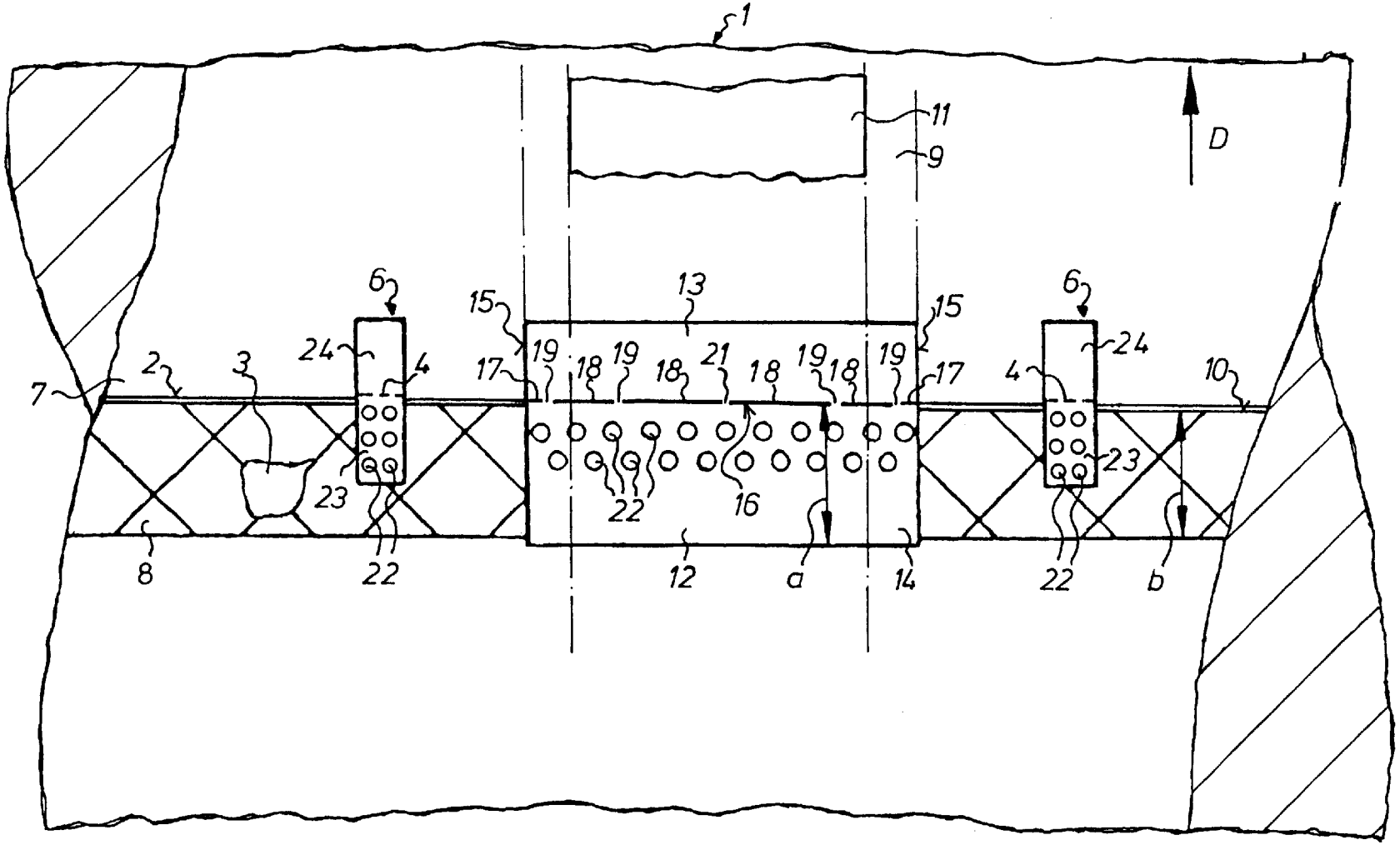
FIG. 1, a front view of a portion of a paper web supply roll 1 with a first preferred embodiment of a prepared adhesive by means of holding labels extending in an axis-parallel direction, and with an adhesive label for the belt travel area.

A cut edge 2 of the beginning 3 of a paper web formed on a paper web supply roll 1, and extending in an axis-parallel or oblique direction, is maintained on a second layer 7 of the paper web supply roll 1 by means of holding labels 6, which are adhesive on one side and which are provided, for example, with a tear line or perforation line 4, all as seen in FIG. 1. An adhesive application, for example an adhesive strip 8 with adhesive on both sides, extends parallel with the cut edge 2, wherein an adhesive strip leading edge 10 is located in the immediate vicinity (for example within, one millimeter) from the cut edge 2 of the beginning 3 of the paper web. One or several adhesive labels 12, which are adhesive on their underside, are arranged in a drive belt travel area or drive belt contact area 9, in which a drive belt 11 of a supply paper web acceleration device acts on the circumference of the paper web supply roll 1. The adhesive labels 12 have been glued on in such a way that in the operating direction of rotation D of the supply roll 1 a leading label element 13 of each adhesive label 12 is located on the second layer 7 of the paper web supply roll 1. A trailing label element 14 of the adhesive label 12 projects past the cut edge 2 of the beginning 3 of the paper web and bridges, or covers, the adhesive strip 8 in the travel or contact area 9 of the drive belt 11.

A predetermined tear line 16, delimits both label elements 13, 14. This tear line 16 extends between the label element 13 and the label element 14 of the adhesive label 12.

The predetermined tear line 16 consists of perforation openings spaced apart from each other in the axial direction of the paper web supply roll 1. In the applied state of the adhesive label 12 the tear line 16 extends along the cut edge 2 of the beginning 3 of the paper web. For example, the perforation openings consist of strips 19, 21 of label 12 with slits 17, 18 arranged between them The two axially outer strips 19, respectively located in the vicinity of each lateral edge 15 of the adhesive label 12, are longer, for example 5 mm, than the center strip 21, which is, for example, 2 mm Therefore the center strip 21 is shorter with respect to the strips 19 close to the lateral elements 15, since less force is exerted at this location when the predetermined tear line 16 is torn open. The drive belt 11 extends in such a way that its width ends approximately centered between the outer strips 19. Respective lateral edge cuts 17 are located at each lateral edge of the adhesive label 12. Because of this, the predetermined tear line 16 is preset when the paper web supply roll 1 is torn open at its cut edge 2.

Figure 2:
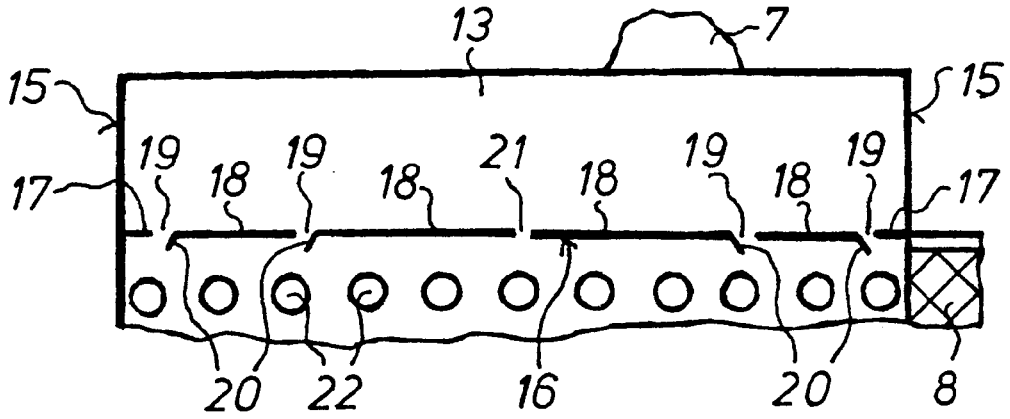
FIG. 2, an enlarged representation of a predetermined tear line of an adhesive label in accordance with a second preferred embodiment.

In accordance with a second preferred embodiment of the present invention, as seen in FIG. 2, an end 20 of a slit 18 respectively located in the vicinity of a strip 19, can also point obliquely in respect to the predetermined tear line 16 in the direction of the holes 22 in the cover element 14. In this way, the trailing label or cover element 14 at least partially covers the adhesive strip 8.

It is also possible to guide two obliquely directed ends 20 of a slit 18 simultaneously both in the direction toward the holes 22 and in the direction of the leading label element 13.

Figure 3:
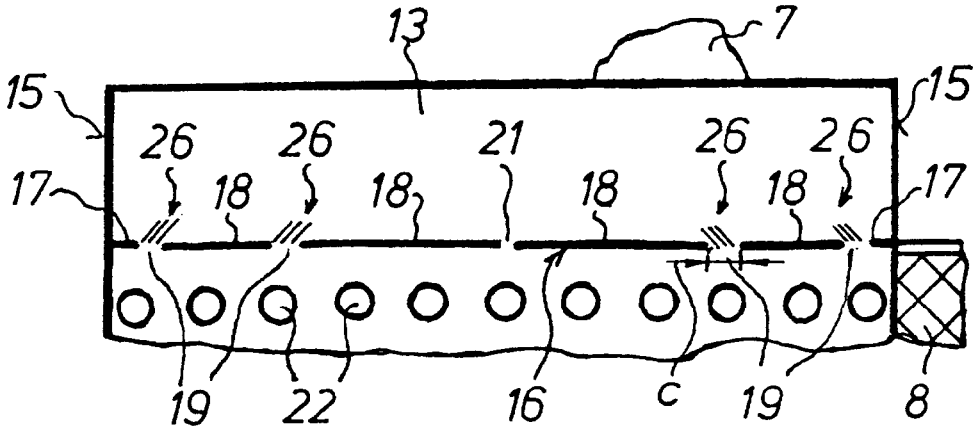
FIG. 3, a representation analogous to FIG. 2 in accordance with a third preferred embodiment.

In accordance with a third preferred embodiment of the present invention, as seen in FIG. 3, each strip 19 can have, starting at the predetermined tear line 16, several slits 26 extending obliquely next to each other over the entire length "c" of each strip 19. These slits 26 can be located on the leading label element 13 as well as on the trailing label element 14.

The trailing label element 14 has, for example, a width "a" of 55 mm, which width "a"must at least correspond to a width "b" of 50 mm of the two-sided adhesive strip 8, as seen in FIG. 1. The leading label element 13 can be of the same width, or can be wider or narrower than the width "a" of the trailing label element 14. A number of holes 22, spaced apart next each other, are arranged in the trailing label element 14, at least in the vicinity of the predetermined tear line 16. Means adjoining the predetermined tear line 16 or slightly spaced apart from it, for example by 1 millimeter, are arranged in the vicinity of the predetermined tear line 16. The holes 22 can also occupy the entire width "a" of the trailing label element 14.

The holes 22 can be circular, oval or rectangular, or can have other geometric shapes.

A grooved or scored line, i.e. a line weakened or reduced continuously in paper thickness, can also be used as predetermined tear line 16.

During acceleration of the paper web supply roll 1, the drive belt 11 runs on the paper web supply roll 1 in the travel area 9 and comes into contact with the adhesive label 12 which consists of the two elements 13, 14 and which covers the two-sided adhesive strip 8 in the travel area 9. In the course of connecting the beginning 3 of the paper web of the fresh paper web supply roll 1 with a paper web of a paper web roll, not represented, which for example is running out, the running-out paper web is pressed against the adhesive strip 8 and an adhesive connection is made. The running-out paper web is pressed on the area of the adhesive strip 8 which is covered by the adhesive label 12 by a contact-pressure roller in such a way, that the running-out paper web comes into contact, through the holes 22, with the adhesive of the adhesive strip 8 located underneath the holes 22. The perforations 4, 16 of the holding and adhesive labels 6, 12, respectively are then torn open.

It is furthermore possible to also provide the leading label element 13 of the adhesive label 12 with holes 22.

In accordance with a further characteristic of the present invention, it is also advantageous if the two-part holding labels 6, which have a perforation 4 over the cut edge 2, are also provided with holes 22 that are, at least located in the label element 23 which is trailing, in the operating direction of rotation D of the paper web supply roll. The holes 22 are at least located in the vicinity of the predetermined tear line 4. By means of this, it becomes possible that the trailing label element 23 of this holding label 6 is glued to the adhesive strip 8 and at least partially covering it, while its leading label element 24 is glued to the second layer 7 of the paper web supply roll 1. In the course of connecting the paper webs, the running-out paper web can also come into contact with the adhesive strip 8 through the holes 22 in the trailing label element 24 of the holding label 6.

It is furthermore possible to also provide the leading label element 24 of the holding label 6 with holes 22.

In its length extending in the axial direction of the paper web supply roll 1, the adhesive label 12 can also be of such dimensions that several adhesive labels 12, arranged directly one next to the other, can be provided in the travel area 9 of the drive belt 11.

It is necessary that at least the leading label element 13, 24 of each of the adhesive label 12 and of the holding label 6, respectively has an adhesive application on the side facing the supply roll 1, i.e. the second layer 7 of the paper web supply roll 1.

While preferred embodiments of an adhesive label in accordance with the present invention have been set forth fully and completely hereinabove, it will be apparent that a number of changes in, for example the size of the paper web supply roll, the operation of the drive belt, and the like can be made without departing from the true spirit and scope of the present invention which is accordingly to be limited only by the following claims.

What is claimed is:

1. In combination an adhesive label attached to a beginning end of a paper web wound in a paper web supply roll, said paper supply roll having an adhesive strip of a first width secured adjacent a cut edge of said beginning end of said web wound on said paper web supply roll, said adhesive label having a leading adhesive label element; a trailing adhesive label element, said leading and trailing adhesive label elements being joined together along a central tear line; and a plurality of holes formed in said adhesive label in at least said trailing adhesive label element, said plurality of holes in said trailing adhesive label element overlying said adhesive strip when said adhesive label is applied to said paper roll, said trailing adhesive label element having a second width, said second width being at least as great as said first width of the adhesive strip.

2. The combination of claim 1 wherein said plurality of holes are formed in at least said trailing adhesive label element at least in a portion of said at least trailing adhesive label adjacent said central tear line.

3. The combination of claim 1 wherein said holes have defined geometrical shapes.

4. The combination of claim 1 wherein said tear line is oriented adjacent the cut edge of the beginning of said paper web.

5. The combination of claim 1 wherein said central tear line is defined by a plurality of perforation openings spaced apart from each other.

6. The combination of claim 5 wherein said plurality of perforation openings are a plurality of spaced slits and further wherein said plurality of spaced slits are spaced from each other in an axial direction of the paper web supply roll by a plurality of strips defined by non-perforated spaces between said plurality of spaced slits, said plurality of strips including at least two axially outer strips and a central strip.

7. The combination of claim 6 wherein said adhesive label further includes spaced lateral edges and further wherein said axially outer strips are spaced from said lateral edges of said adhesives label and have a first length and said central strip is located centrally in said adhesive label and has a second length, said second length being less than said first length.

8. The combination of claim 7 wherein one of said plurality of spaced slits is located adjacent each of said outer strips and has an outer slit end, each said outer slit end pointing in a direction oblique to said central tear line.

9. The combination of claim 1 further including a plurality of said holes formed in said leading adhesive label element.

10. The combination of claim 1 wherein the paper web supply roll has a drive belt travel area and further wherein said adhesive labels are applicable to the paper web supply roll in the drive belt travel area.

* * * * *